US006611082B1

(12) United States Patent
McGuire

(10) Patent No.: US 6,611,082 B1
(45) Date of Patent: Aug. 26, 2003

(54) LAMP FOR PRODUCING DAYLIGHT SPECTRAL DISTRIBUTION

(75) Inventor: Kevin P. McGuire, Rochester, NY (US)

(73) Assignee: Tailored Lighting Inc., Rochester, NY (US)

( * ) Notice: Subject to any disclaimer, the term of this patent is extended or adjusted under 35 U.S.C. 154(b) by 310 days.

(21) Appl. No.: 09/592,192

(22) Filed: Jun. 12, 2000

Related U.S. Application Data

(63) Continuation-in-part of application No. 09/193,360, filed on Nov. 17, 1998, now Pat. No. 6,075,872, which is a continuation-in-part of application No. 08/923,563, filed on Sep. 4, 1997, now Pat. No. 5,977,694.

(51) Int. Cl.[7] ..... H01J 5/16

(52) U.S. Cl. ..... 313/110; 313/112; 313/113; 362/293; 362/361

(58) Field of Search ..... 313/110, 112, 313/113, 117, 634, 635; 362/293, 321, 351, 361; 359/359

(56) References Cited

U.S. PATENT DOCUMENTS 4,642,514 A * 2/1987 English et al. ..... 313/111
4,870,318 A * 9/1989 Csanyi et al. ..... 313/113
5,666,017 A * 9/1997 McGuire ..... 313/310
5,977,694 A * 11/1999 McGuire ..... 313/110

* cited by examiner

*Primary Examiner*—Vip Patel
*Assistant Examiner*—Joseph Williams
(74) *Attorney, Agent, or Firm*—Greenwald & Basch LLP; Howard J. Greenwald

(57) ABSTRACT

An integral lamp for producing a spectral light distribution substantially identical in uniformity to the spectral light distribution of a desired daylight with a color temperature of from about 3250 to about 10,000 degrees Kelvin throughout the entire visible light spectrum from about 380 to about 780 nanometers. The lamp contains a enclosed lamp envelope having an interior surface and an exterior surface, a light producing element which emits radiant energy throughout the entire visible spectrum with wavelengths from about 200 to about 2,000 nanometers at non-uniform levels of radiant energy across the visible spectrum, and at least one coating on at least one of said surfaces and having a transmittance level in substantial accordance with the formula D(L)=[O(L)−F(L)×S(L)]/[S(L)×{1−F(L)}], wherein: 1.O(L) is the desired daylight spectral output, D(L) is the spectral transmission of the coating, S(L) is the spectral output of the source, and F(L) is the likelihood of the reflected wavelength of light missing the element.

12 Claims, 7 Drawing Sheets

LAMP FOR PRODUCING DAYLIGHT SPECTRAL DISTRIBUTION

CROSS-REFERENCE TO RELATED PATENT APPLICATIONS

This application is a continuation-in-part of U.S. patent application U.S. Ser. No. 09/193,360, filed Nov. 17, 1998 and issued on Jun. 13, 2000 as U.S. Pat. No. 6,075,872, which in turn was a continuation-in-part of U.S. patent application U.S. Ser. No. 08/923,563, filed on Sep. 4, 1997 and issued as U.S. Pat. No. 5,997,694. The entire disclosure of each of these United States patents is hereby incorporated by reference into this specification.

FIELD OF THE INVENTION

A lamp for producing a spectral light which is substantially identical in uniformity to the spectral light distribution of a desired daylight.

BACKGROUND OF THE INVENTION

U.S. Pat. No. 5,666,017 describes a lamp for producing a spectral light which is substantially identical in uniformity to the spectral light distribution of a desired daylight throughout the entire visible light spectrum from about 380 to about 780 nanometers. The lamp contains a lamp envelope comprised of an exterior surface, a light-producing element substantially centrally disposed within said lamp envelope, and a coating on said exterior surface of said lamp envelope. The entire disclosure of this United States patent is hereby incorporated by reference into this specification.

U.S. Pat. No. 5,666,017 was a marked improvement over prior patent U.S. Pat. No. 5,418,419 because the former patent did not require the presence of a reflector; the entire disclosure of each of these United States patents (and of each of the United States patents mentioned in this specification) is hereby incorporated by reference into this specification. An equation used to specify the desired transmittance level of the coating at each wavelength was developed to describe the portion of the light that was directed at normal and non-normal incidence towards the coating. The portion of light normally incident upon the lamp envelope was considered to have a high probability of exiting the envelope with the desired daylight qualities with the reflected portion having a high probability of being reflected back to the filament, absorbed and re-emitted. The non-normal light on the other hand was considered to have a high probability of exiting the lamp at levels that varied from the desired daylight spectrum and the reflected portion having a low probability of being directed back to the filament and instead finding its way out of the lamp cavity through multiple reflections.

It is an object of this invention to provide an improved daylight lamp in which a greater portion of the light exiting the lamp simulates daylight.

It is another object of this invention to provide an improved daylight lamp in which the light produced more accurately simulates daylight.

It is yet another object of this invention to provide a daylight lamp which produces better uniformity in its spectral output using a single reflector and multiple cover glasses.

It is yet another object of this invention to produce a daylight lamp which produces multiple daylight outputs and/or beamspreads.

SUMMARY OF THE INVENTION

In accordance with this invention, there is provided an improved lamp for producing a spectral light which is substantially identical in uniformity to the spectral light distribution of a desired daylight throughout the entire visible light spectrum from about 380 to about 780 nanometers. The lamp contains a lamp envelope comprised of an exterior surface, a light-producing element substantially centrally disposed within said lamp envelope, and a coating on said exterior surface of said lamp envelope.

BRIEF DESCRIPTION OF THE DRAWINGS

The claimed invention will be more fully understood by reference to following detailed description thereof, when read in conjunction with the attached drawings, wherein like reference numerals refer to like elements, and wherein:

DESCRIPTION OF THE PREFERRED EMBODIMENTS

As is taught in U.S. Pat. No. 5,666,017, and in the lamp described therein, in order to correct and greatly reduce the amount of non-normal light incident towards the coating, an elliptical burner according to claim 7 of patent number 5,666,017 is preferably utilized. The advantages of using such an elliptical burner are illustrated in FIGS. 4 and 5.

Figure 4:
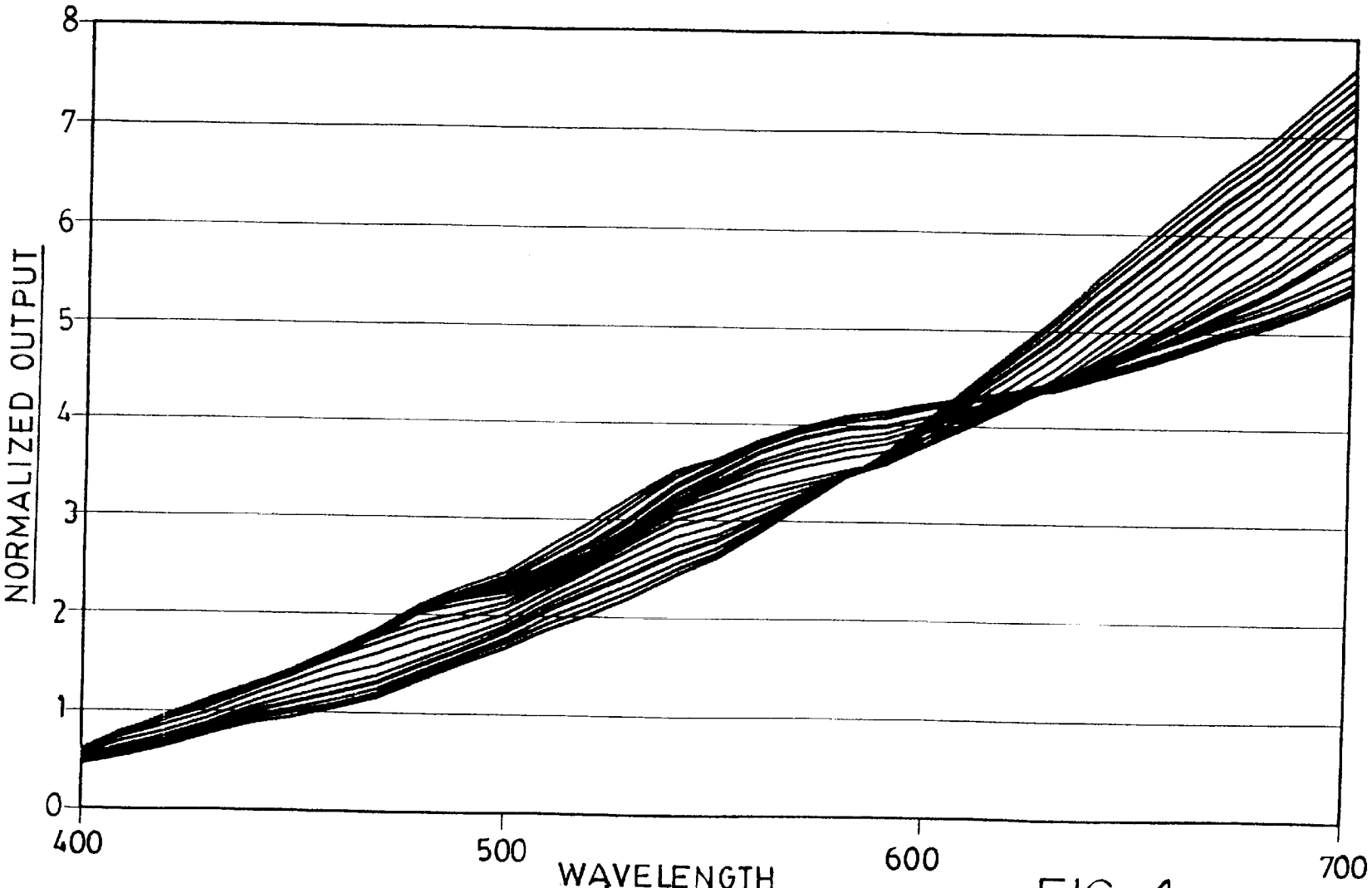
FIG. 4 is a graph of the spectral output of a daylight lamp with substantially cylindrical lamp envelope.
Figure 5:
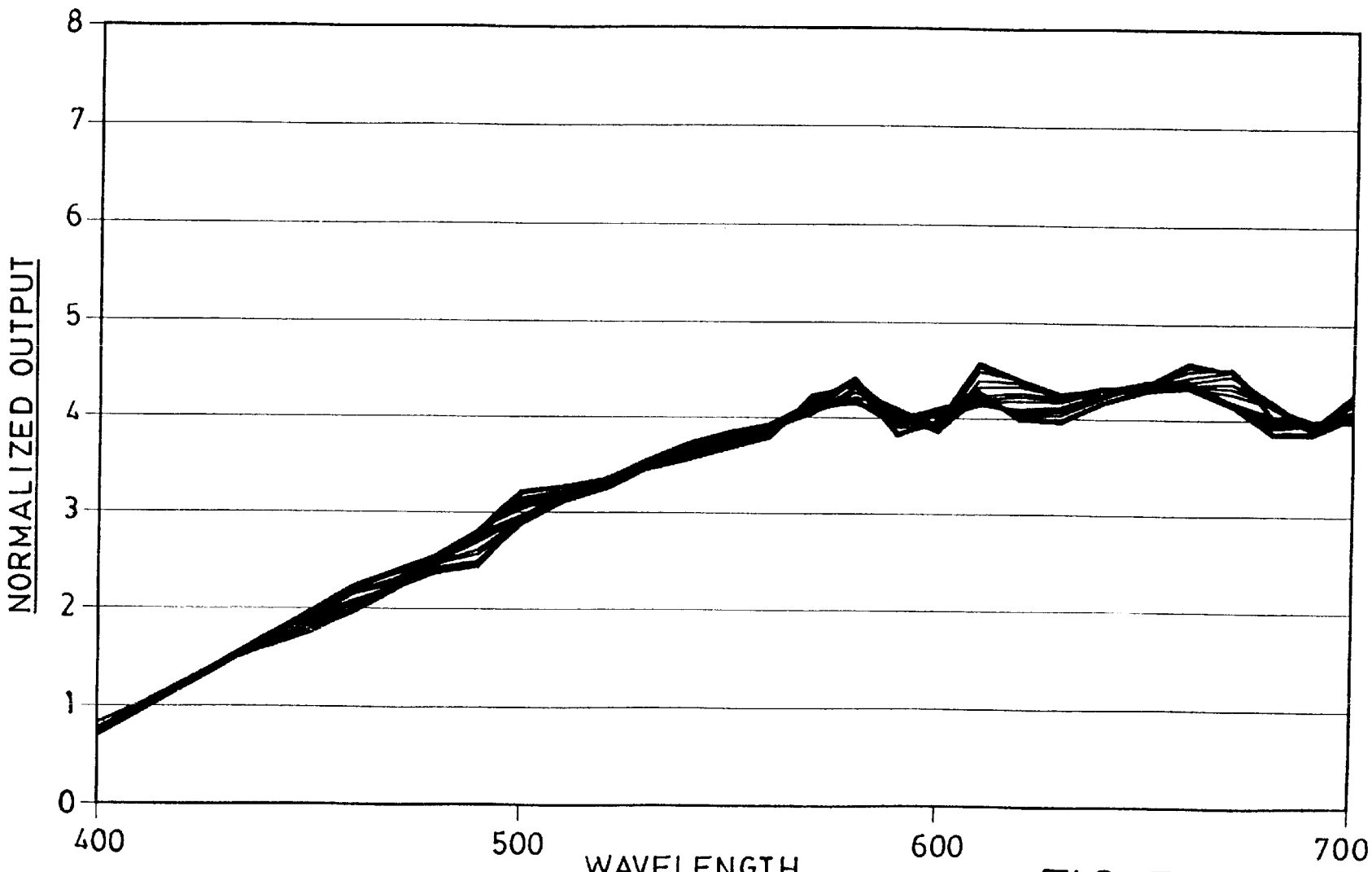
FIG. 5 is a graph of the spectral output of a daylight lamp with a substantially elliptical lamp envelope.

FIGS. 4 and 5 reflect data produced from an experiment in which a daylight lamp produced in substantial accordance with U.S. Pat. No. 5,666,017 was evaluated by measuring its spectral output with a fiber optic spectroradiometer at the center point of the lamp envelope located 18 centimeters away, from the lamp envelope, with one-centimeter incremental measurements starting 10 centimeters above such center point, and ending 10 centimeters below such center point.

FIG. 4 shows data produced when the lamp envelope used was substantially cylindrical. The color temperature of the lamp used ranged from 2565 degrees Kelvin to 3451 degrees Kelvin. Wavelength, in nanometers, was plotted on the X axis. Normalized output was plotted on the Y axis. As can be seen from the plot of the data in FIG. 4, the range of spectral outputs produced varied substantially, especially at the higher wavelengths. The normalized output obtained had uniformity that was less than ideal.

FIG. 5 is graph of normalized output versus wavelength which is similar to that of FIG. 4, with the exception that the data was generated from a lamp which utilized an elliptical lamp envelope; the color temperatures measured ranged from 3216 to 3446 degrees Kelvin. As will be apparent, and as is indicated by the color temperatures measured, a much tighter spectral distribution was obtained. Thus, the use of the elliptical lamp envelope produced a substantially more uniform output.

The more uniform spectral output depicted in FIG. 5 has less non-normal light in it. This non-normal light tends to look pink.

The more uniform spectral output depicted in FIG. 5, however, appeared to have a green tint. This impression was verified when graphs depicted in FIGS. 1, 2, and 3 where prepared.

Figure 1:
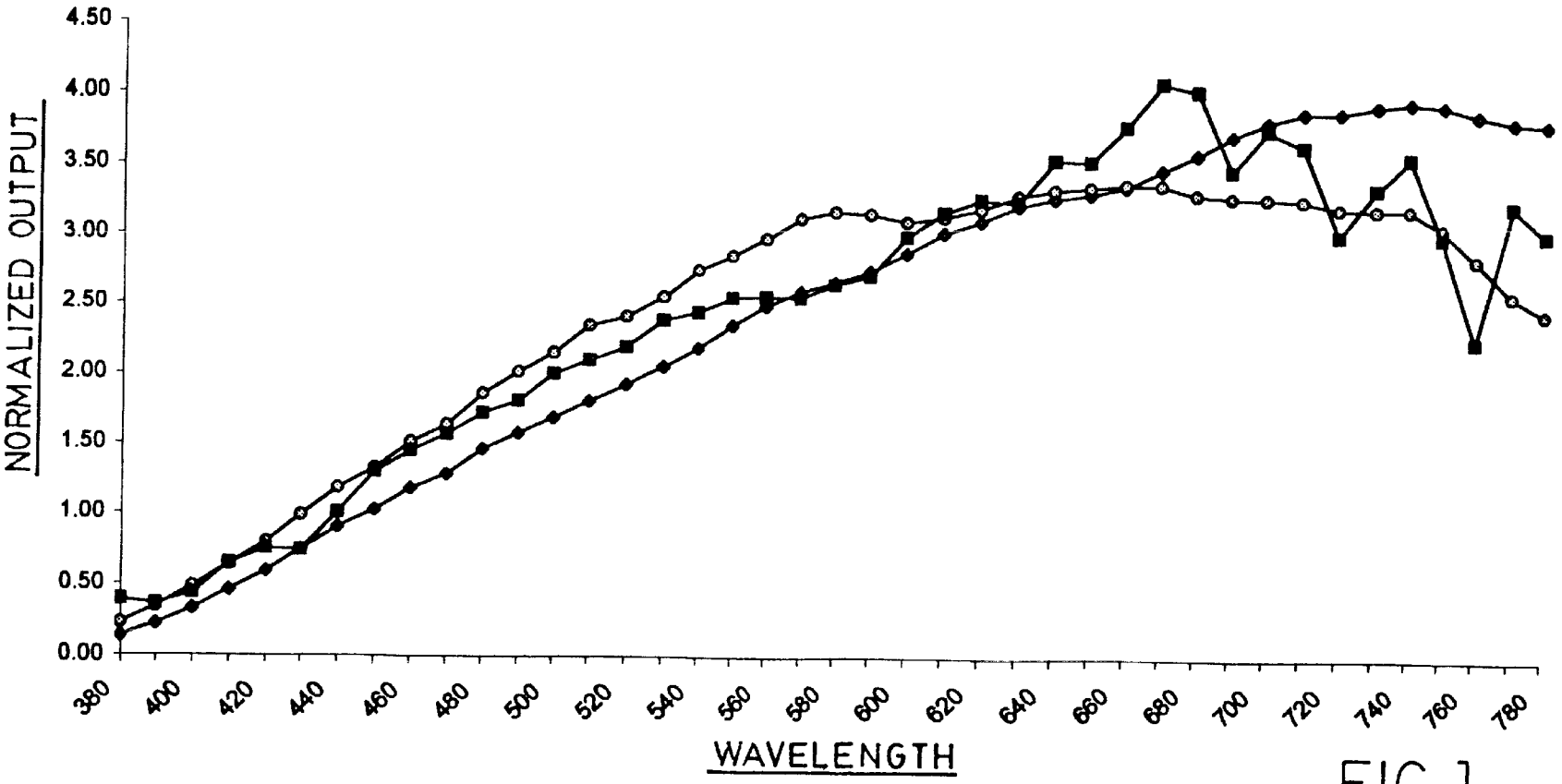
FIG. 1 is graph of three different spectral power distributions at a color temperature of 3,250 degrees Kelvin for daylight, for the lamp of U.S. Pat. No. 5,666,017, and for the lamp described and claimed in this patent application.
Figure 2:
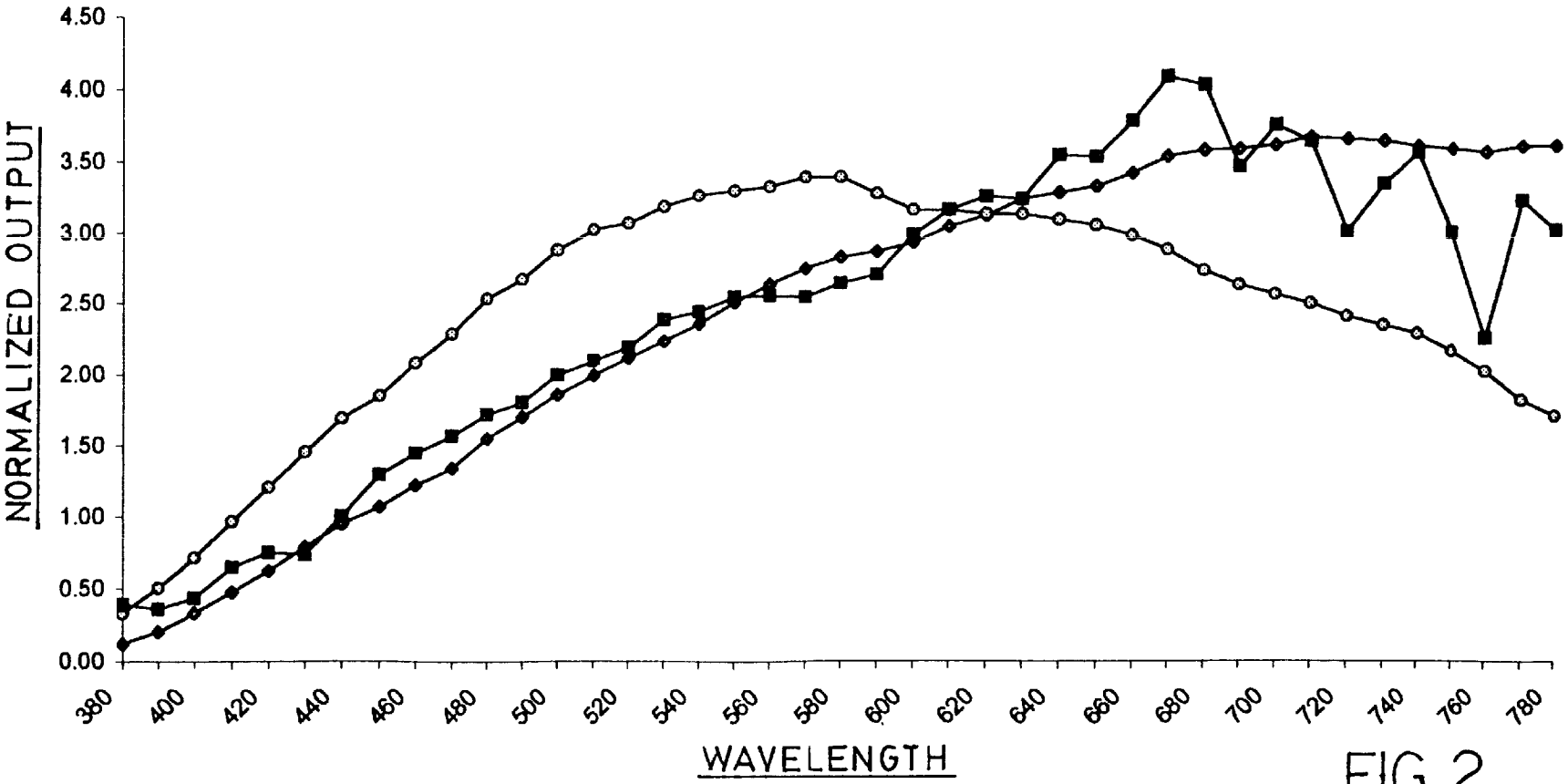
FIG. 2 is graph of three different spectral power distributions at a color temperature of 3,500 degrees Kelvin for daylight, for the lamp of U.S. Pat. No. 5,666,017, and for the lamp described and claimed in this patent application.
Figure 3:
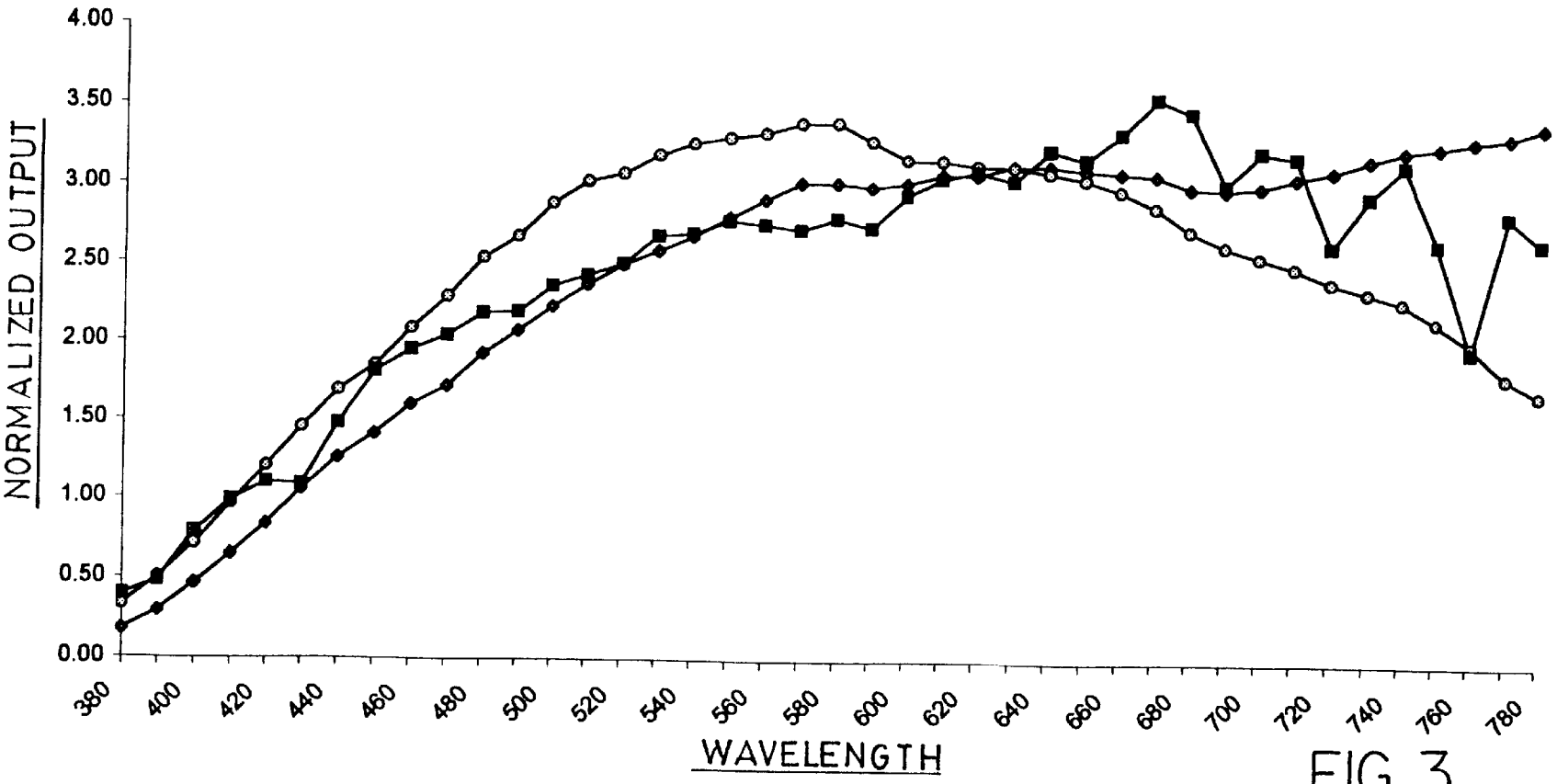
FIG. 3 is graph of three different spectral power distributions at a color temperature of 4,100 degrees Kelvin for daylight, for the lamp of U.S. Pat. No. 5,666,017, and for the lamp described and claimed in this patent application.

In each of the graphs of FIGS. 1, 2, and 3, normalized output was plotted against wavelength. In the graph of FIG. 1, the target color temperature sought was 3,250 degrees Kelvin. In the graph of FIG. 2, the target color temperature sought was 3,500 degrees Kelvin. In the graph of FIG. 3, the target color temperature sought was 4100 degrees Kelvin.

In each of these graphs, the lines plotted with circle points reflect the output from a lamp produced in accordance with U.S. Pat. No. 5,666,107, using an elliptical lamp envelope. The lines plotted with the diamond points reflect the output from a lamp produced in accordance with this specification. The lines plotted with the square points are reference lines reflecting the idealized daylight conditions.

As is known to those skilled in the art, wavelengths greater than about 700 nanometers, and wavelengths less than about 400 nanometers, are not generally perceived by the human eye. Thus the critical portions of the graphs to be evaluated in FIGS. 1, 2, and 3 are those portions depicting outputs at wavelengths from 400 to 700 nanometers.

It will be apparent that the spectral output of the lamp produced in accordance with this invention is substantially closer to daylight over the wavelength range of 400 to 700 nanometers than is the spectral output of the lamp produced in accordance with U.S. Pat. No. 5,666,107, even though both lamps utilized exactly the same elliptical lamp envelope. It is believed that the new lamp described by applicant in this specification is clearly patentable over the prior art.

Applicant has developed a new equation which should be used to specify the transmission qualities of the coating used in this claimed lamp. In this equation, the following variables are used: O(L) is the desired daylight spectral output, D(L) is the spectral transmission of the coating, S(L) is the spectral output of the source, and F(L) is the likelihood of the reflected wavelength of light missing the filament The equation which describes the likelihood of a reflected light ray missing the filament, F(L), is as follows:

$$F(L)=[-1.7333\times10^{-4}-9.3333\times10^{-7}K][L^4\times R]^0+.21[L^4\times R]^1+[-4.7708\times10^{-1}+2.3167\times10^{-1}+2.3167\times10^{-5}K[L^4\times R]^2$$

and wherein: L is wavelength in nanometers, R is a constant equal to 5595581692912, and K is the desired daylight color temperature in degrees Kelvin. The value F is then normalized with the largest chance of a light ray or photon missing the filament and set to 100%.

When designing a transmission specification for a desired daylight output, one may solve for D, yielding: D(L)=[O(L)−F(L)×S(L)]/[S(L)×{1-F(L))}] The sum of O(L) needs to set equal to D(L)×S(L)+[1-D(L)]×F(L)×S(L) resulting in a iterative process to yield the optimal design.

Figure 9:
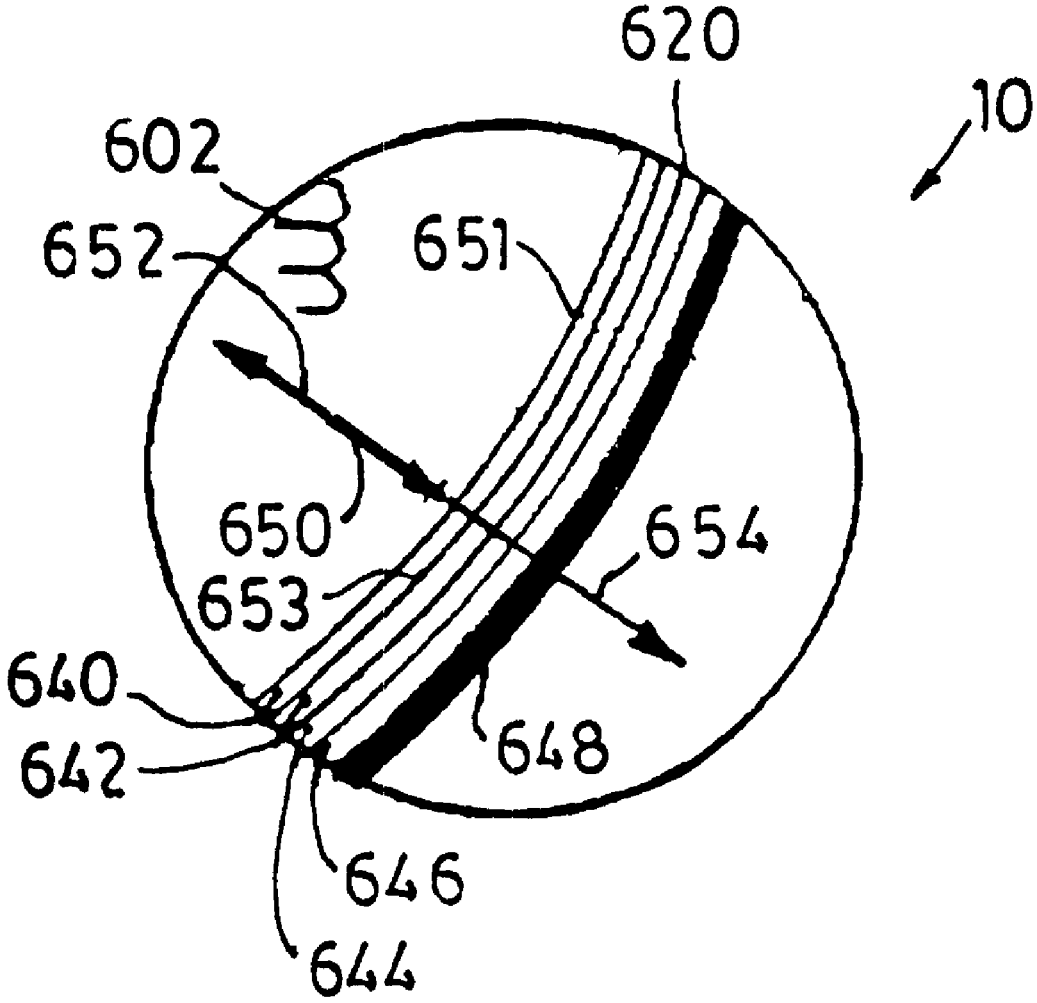
FIG. 9 is a sectional view of a portion of a lamp envelope illustrating one preferred coating thereon.

FIG. 9 is a sectional view of one preferred lamp 10, illustrating coating 620. Referring to FIG. 9, it will be seen that, in the preferred embodiment depicted, coating 620 is comprised of substrate 640, first coated layer 642, second coated layer 644, third coated layer 646, and fourth coated layer 648.

In the embodiment depicted in FIG. 9, substrate 640 preferably consists essentially of a transparent material such as, e.g., plastic or glass and has a thickness of from about 0.5 to about 1.0 millimeters. In one preferred embodiment, the substrate material is transparent borosilicate glass. In another embodiment, transparent synthetic fused quartz glass is used as the substrate.

Referring again to FIG. 9, it will be seen that each of coatings 642, 644, 646, and 648 consists essentially of a is a dielectric material (such as magnesium fluoride, silicon oxide, zinc sulfide, and the like) which has an index of refraction which differs from the index of refraction of any other layer adjacent and contiguous to such layer. In general, the indices of refraction of these coatings range from about 1.3 to about 2.6. Each of the layers is deposited sequentially onto the substrate as by chemical vapor deposition, sputtering, or other well-known methods.

Referring again to FIG. 9, it will be seen that coating 620 intercepts a multiplicity of light rays (not shown) including normal incident light ray 650. A portion 652 of light ray 650 is reflected; another portion 654 of light ray 650 is transmitted.

In the preferred embodiment depicted in FIG. 9, the coating 620 is preferably contiguous with the exterior surface 653 of the substrate 640. In another embodiment, not shown, the coating 620 is contiguous with the interior surface 651 of substrate 640. In one embodiment, where the coating is on the exterior surface 653, the coating 620 reflects back to the filament 602 at least about 30 percent of all of the radiation emitted by filament 602.

In one embodiment, the substrate 640 is comprised of or consists essentially of a material that absorbs ultraviolet light. Thus, by way of illustration and not limitation, one may use a ultraviolet-absorbing glass substrate sold by the Osram Company of Germany. One may also use an ultraviolet-absorbing glass substrate sold by the Phillips Lighting Company of Eindhoven, Netherlands.

In one embodiment, the coating 620 prevents the transmission of at least about 90 percent of ultraviolet radiation with a wavelength of from about 200 to about 380 nanometers emitted by the filament 602. One may use any of the filaments well known to those skilled in the art as filament 602 (see, e.g., the filaments used in applicant's United States Patents). Alternatively, or additionally, one may use or light-producing elements such as, e.g., those found in metal-halide lamps.

In one embodiment, the filament 602 is disposed at a distance of less than about 8 centimeters from substrate 640.

In one embodiment, the filament 602 has a color temperature of at least about 2,000 degrees Kelvin.

In one embodiment, the coating 620 reflects at least about 95 percent of the infrared radiation with a wavelength of from about 780 to about 3,000 nanometers emitted by filament 602.

With applicant's invention, one is able to "tune" a single light source to different daylight color temperatures for different applications, situations, and environments. A means to produce multiple daylight conditions from a single light source is to mask off certain areas of the lamp envelope during the coating process or to remove portions of the coating material after the coating process by chemical or mechanical means such as sandblasting. Different patterns can be created for different lamp geometries and different apertures. The combining of daylight and incandescent light is well known in the art see applicant's prior U.S. Pat. No. 5,083,252, 5,079,683, 5,329,435, 5,282,115. The uniqueness of this device is all the various spectrums are created with a single source and can be varied be moving or rotating the burner in relationship to an aperture or visa versa.

Figure 8:
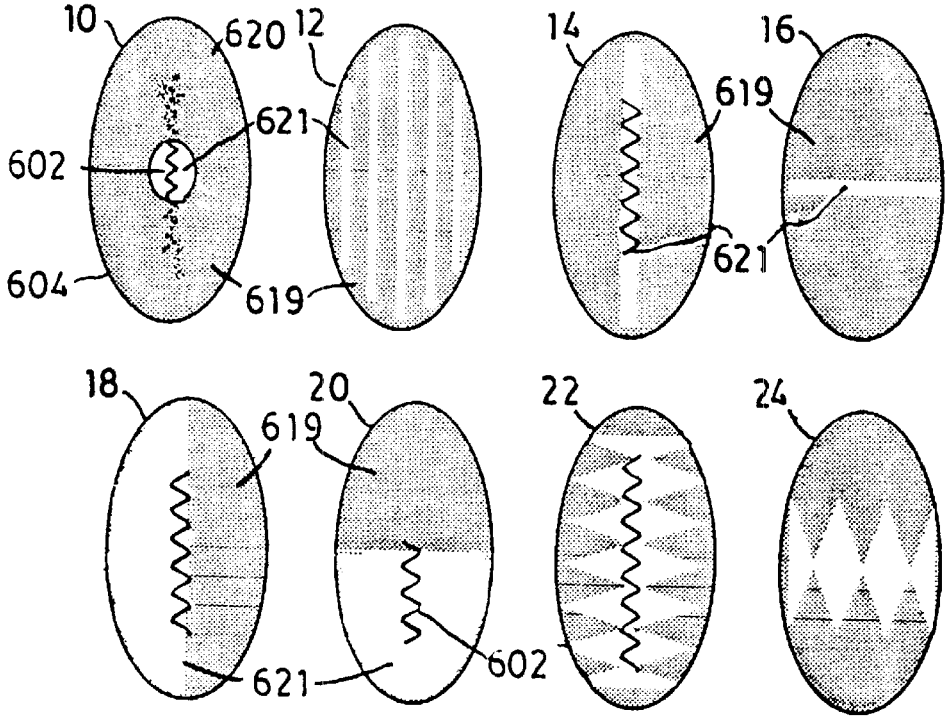
FIG. 8 depicts different configurations of lamp envelopes with various patterns of coating which may be used in the preferred lamp of this invention.

FIG. 8 illustrates various lamp envelope assemblies 10, 12, 14, 16, 18, 20, 22, and 24, which may be used in applicant's invention. Referring to FIG. 8, it will be seen that each of these lamp envelopes assemblies is comprised of a coating 620 (also see FIG. 19 of U.S. Pat. No. 5,666,017), a centrally-disposed filament 602, and a lamp envelope 604. In each of these lamp envelope assemblies, the coating 620 is indicated by the shaded area 619. The areas which are not coated are indicated by the non-shaded portions 621. As will apparent to those skilled in the art, and as is taught in, e.g., applicant's United States patents applicant's prior U.S. Pat. No. 5,083,252, 5,079,683, 5,329,435, 5,282,115 (the entire disclosures of which is hereby incorporated by reference into this specification), the extent to which the non-coated portions are covered by an movable aperture (not shown), the color temperature produced by the lamp may be varied. Alternatively, this result may be obtained by the use of a movable lamp and a stationary aperture. The daylight spectrum produced could range from about 3250K up to and including 10,000K with the non daylight spectrum ranging from 2000K to 3100K.

In addition to the previous enhancement, one may also combine the daylight burner with a small reflector such as a MR-16 or MR-11 with or without a cover glass. If a cover glass is not used, multiple reflectors are preferred to create different desired beam spreads, as is well known in the art. Another approach would be to use a single reflector with multiple cover glasses to produce the desire beamspread effect. The cover glasses would triple as a protection for the daylight burner, a means to produce the desired beam spread effect, and also even out any non-uniformities in the beam.

Figure 6:
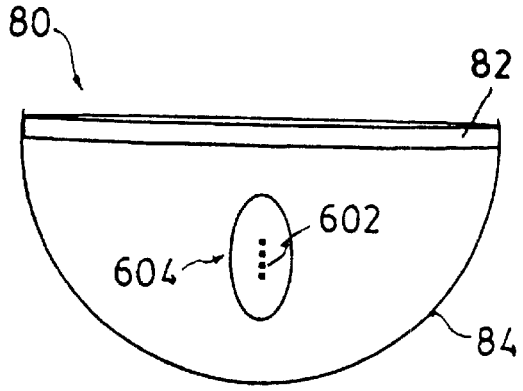
FIG. 6 is a sectional view of the preferred lamp of this invention.
Figure 7:
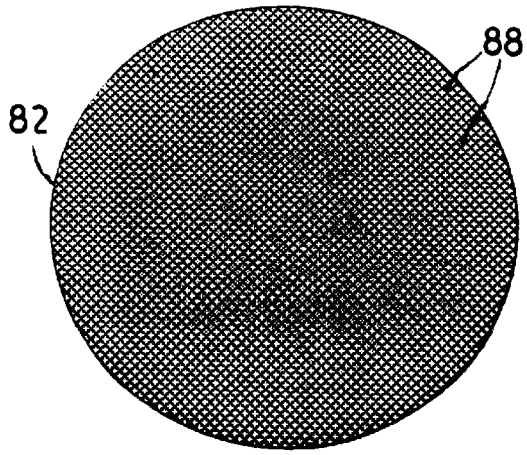
FIG. 7 is top view of a diffuser glass which is used in one of the preferred lamps of this invention.

FIG. 6 is a sectional view, with unnecessary detail omitted, of a lamp 80 with a fixed cover glass 82 and a reflector 84, a top view of which is presented in FIG. 7. In one embodiment, using this assembly, a 10 degree beamspread may advantageously be obtained using a cover glass 82 comprised of microscopic raised protuberances 88 which range from about 180 to about 220 nanometers in height and are preferably spaced in a hexagonal pattern, with centers approximately frp, about 280 to about 320 nanometers apart. This sub-wavelength surface relief profile provided by this cover glass pattern is a low reflectance interface for light. Cover glasses with these protuberances are commercially available and may be obtained from the Fresnel Optics Company of 1300 Mount Read Boulevard, Rochester, N.Y. under the name of "Moth-Eye Antireflection Microstructure").

For 12 degrees beamspread, one may used raised protuberances approximately 0.127 mm in height (plus or minus about 0.01 millimeters) and spaced in a hexagonal pattern with centers approximately 2.51 mm apart (plus or minus about 0.01 millimeters); cover glasses with such structure may be obtained, e.g., from the Corning Glass Works of Corning, N.Y. For 25 degrees beamspread, one may used raised protuberances approximately 0.254 mm in height (plus or minus about 0.01 millimeters) and spaced in a hexagonal pattern with centers approximately 2.59 mm apart (plus or minus about 0.01 millimeters). For 60 degrees beamspread, one may use raised protuberances approximately 2.16 mm in height (plus or minus about 0.01 millimeters) and spaced in a square pattern with centers approximately 4.08 mm apart (plus or minus about 0.01 millimeters).

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

It should also be understood that, as used in this specification, the term "substantially identical," as used with respect to a desired daylight output, refers to a total light output which, at each of the wavelengths between about 400 and 700 nanometers on a continuum, is within about 30 percent of the O(L) value determined by the formula used in applicants United States patents, and wherein the combined average of all of said wavelengths is within about 10 percent of the combined O(L) of all said wavelengths. Thus, e.g., this specification includes the production of a spectral light which is substantially identical to in uniformity to the spectral light distribution of a desired back body radiator.

I claim:

1. An integral lamp for producing a spectral light distribution substantially identical in uniformity to the spectral light distribution of a desired daylight with a color temperature of from about 3250 to about 10,000 degrees Kelvin throughout the entire visible light spectrum from about 380 to about 780 nanometers, comprising:

(a) an enclosed lamp envelope having an interior surface and an exterior surface, (b) a light-producing element substantially centrally disposed within said lamp envelope and which, when excited by electrical energy, emits radiant energy throughout the entire visible spectrum with wavelengths from about 200 to about 2,000 nanometers at non-uniform levels of radiant energy across the visible spectrum;

(c) at least one coating on at least one of said surfaces and having a transmittance level in substantial accordance with the formula $D(L)=[O(L)-F(L)\times S(L)]/[S(L)\times\{1-F(L)\}]$, wherein:

1.O(L) is the desired daylight spectral output, D(L) is the spectral transmission of the coating, S(L) is the spectral output of the source, and F(L) is the likelihood of the reflected wavelength of light missing the element, 2. F (L)defined by the equation $F(L)=[-1.7333\times10^{-4}-9.3333\times10^{-7}K][L^4\times R]^0+.21[L^4\times R]^1+[-4.7708\times10^{-1}+2.3167\times10^{-5}K[L^4\times R]^2$, wherein:

(a) L is wavelength in nanometers, (b) R is a constant equal to 5595581692912, and (c) K is the desired daylight color temperature in degrees Kelvin.

2. The lamp as recited in claim 1, wherein said element is disposed at a distance of less than about 8 centimeters from said lamp envelope.

3. The lamp as recited in claim 1, wherein said element has a color temperature of at least about 2,000 degrees Kelvin.

4. The lamp as recited in claim 1, wherein said coating is on said exterior surface of said lamp envelope and reflects back to said element at least 30 percent of all radiation emitted by said element.

5. The lamp as recited in claim 1, wherein the envelope is substantially elliptical in cross section.

6. The lamp as recited in claim 1, wherein said lamp envelope is constructed of a material that absorbs ultraviolet light.

7. The lamp as recited in claim 1, wherein said coating prevents the transmission of at least about 90 percent of the ultraviolet radiation with a wavelength of from about 200 to about 380 nanometers emitted by said element.

8. The lamp as recited in claim 1, wherein said coating reflects at least about 95 percent of the infrared radiation with a wavelength of from about 780 to about 3,000 nanometers emitted by said element.

9. The lamp as recited in claim 1, wherein said lamp envelope consists essentially of a light transmitting material having a thickness from about 0.5 to about 1.0 millimeters and the coating comprises at least four layers each consisting essentially of a dielectric material having an index of refraction within a range of from about 1.3 to 2.6 and which differs from the index of refraction of any other layer which is adjacent and contiguous.

10. The lamp as recited in claim 1, further comprising a reflector disposed around said light producing element.

11. The lamp as recited in claim 10, wherein wherein a cover glass is disposed in front of said light producing element.

12. The lamp as recited in claim 1, wherein a cover glass is disposed in front of said light producing element.

* * * * *